US007695331B2

(12) United States Patent
Kerner

(10) Patent No.: US 7,695,331 B2
(45) Date of Patent: Apr. 13, 2010

(54) ELECTRICAL CONTACT ASSEMBLY INCLUDING A SLEEVE MEMBER

(75) Inventor: Alex Kerner, Pacific Palisades, CA (US)

(73) Assignee: Tri-Star Technology, El Segundo, CA (US)

( * ) Notice: Subject to any disclaimer, the term of this patent is extended or adjusted under 35 U.S.C. 154(b) by 0 days.

(21) Appl. No.: 12/106,866

(22) Filed: Apr. 21, 2008

(65) Prior Publication Data

US 2009/0117787 A1 May 7, 2009

Related U.S. Application Data

(60) Provisional application No. 60/915,398, filed on May 1, 2007.

(51) Int. Cl.
*H01R 4/10* (2006.01)

(52) U.S. Cl. ..... 439/877; 439/932; 174/15.6

(58) Field of Classification Search ..... 439/877, 439/874, 854, 932; 174/15.6
See application file for complete search history.

(56) References Cited

U.S. PATENT DOCUMENTS

| | | | | |
|---|---|---|---|---|
| 4,402,566 | A * | 9/1983 | Powell et al. | 439/589 |
| 4,723,925 | A * | 2/1988 | Orr et al. | 439/877 |
| 5,098,319 | A * | 3/1992 | McGaffigan et al. | 439/874 |
| 5,229,543 | A * | 7/1993 | Strefling | 174/15.6 |
| 5,442,846 | A | 8/1995 | Snaper | |
| 5,499,448 | A * | 3/1996 | Tournier et al. | 29/863 |
| 6,814,632 | B1 | 11/2004 | Peterson | |
| 7,174,633 | B2 * | 2/2007 | Onuma | 29/854 |
| 7,364,478 | B2 * | 4/2008 | Xu | 439/874 |
| 7,618,287 | B2 * | 11/2009 | Hass | 439/589 |
| 2003/0153208 | A1 | 8/2003 | Eastman et al. | |
| 2007/0039168 | A1 | 2/2007 | Schwartzman et al. | |

FOREIGN PATENT DOCUMENTS

| | | |
|---|---|---|
| EP | 1164100 | 9/1969 |
| GB | 896086 | 5/1962 |
| GB | 01164100 | 9/1969 |
| GB | 2057784 | 4/1981 |

* cited by examiner

*Primary Examiner*—Truc T Nguyen
(74) *Attorney, Agent, or Firm*—Bruce A. Jagger

(57) ABSTRACT

A low cost crimpable and sealable contact assembly including a contact member and a tubular sleeve member. The contact member is capable of being manually continuity crimped to a tip of an electrically conductive core of an electrically insulated wire. The tubular sleeve member is then deformed to hermetically seal it to the insulation on the wire, and the contact member. The hermetic seal protects the core from corrosion. This hermetic seal is particularly important where the core comprises aluminum. Separating the crimping and sealing into separate operations permits them to be performed manually. The sleeve member may be comprised of polymeric material, or it may be metallic. The metallic embodiments may be mechanically or electromagnetically deformed. The polymeric sleeve members may, in addition, be heat shrunk.

14 Claims, 4 Drawing Sheets

ELECTRICAL CONTACT ASSEMBLY INCLUDING A SLEEVE MEMBER

RELATED APPLICATIONS

This application claims the benefit of U.S. Provisional Application No. 60/915,398, filed May 1, 2007

BACKGROUND OF THE INVENTION

1. Field of the Invention

The invention relates in general to methods and devices, embodiments of which include electrical contacts that are deformable into electrical continuity and hermetic sealing with an insulated wire, and, more particularly, certain embodiments of the present invention relate to electrical contact assemblies including a deformable sleeve for forming a hermetic seal between a closed barrel electrical contact and an insulated electrical wire to which the electrical contact is mounted.

2. Description of the Prior Art

Electrical contacts are conventionally provided in lieu of solder joints for purposes of providing electrical continuity between the electrically conductive core of an insulated electrical wire and an electrical bus or other device to which it is desired to attach the core. The electrically conductive cores are typically composed of some metallic material such as, for example, copper, silver, gold, aluminum, their alloys, or the like.

Electrical contacts often take a form in which a male or female contactor and a barrel are aligned generally axially along a common axis. The contactor is generally designed as either a male pin to be axially inserted into a socket, or a female socket into which a male pin is to be inserted. In either configuration, the purpose of engaging the male pin and the female socket is to complete an electrical circuit. The barrel has an axially extending cavity or tubular portion that provides an attachment location for the core of an insulated electrical wire. When the barrel is of the type described as a closed barrel, the electrical contact is typically gold plated and there is a small hole radially through the tubular wall of the barrel at approximately the bottom end of the closed axial cavity. This hole is required during the plating of the contact.

During the assembly of the electrical contact to the end of an electrical wire, the insulation is stripped from the tip of the wire to expose a short length of the electrically conductive core of the wire. The short length of exposed core is then inserted into the axial cavity in the tubular barrel of the electrical contact. The core may be either stranded or solid. The tubular wall of the barrel is typically physically crimped into electrical continuity with the bare tip of the core of the wire that is within the axial cavity. According to some previous expedients, the tubular barrel is also deformed, typically by crimping, into a hermetic seal with the insulated coating on the wire.

The tubular barrel of the closed barrel contact is open at the opposed end from the axially remote end of the contactor. The barrel and the contactor are typically formed in one piece aligned generally along a common longitudinal axis. The axially extending cavity that is formed by the tubular barrel is generally closed at the end nearest to the contactor with the radial hole at approximately this closed end.

When the wire is assembled to the electrical contact the bare tip of the core is usually inserted into the tubular barrel from the open end to substantially the full depth of the axial cavity. Previously proposed electrical contact expedients for aluminum core wire typically closed the small hole in the wall of the tubular barrel with a soft metal sleeve that was inserted into the tubular barrel during the manufacturing of the closed barrel electrical contact. The sleeve was thought to serve two purposes. It sealed this small hole and provided a soft metal to conform to the brittle aluminum core during the continuity crimp. This sleeve, however, prevents the end of the core from being visible through the hole in the wall of the barrel when the core is substantially fully inserted into the axial cavity.

When complex wiring harnesses are incorporated into a single installation, such as a large aircraft, that installation may include many thousands of electrical contacts. Such complex wiring harnesses are found, for example, in aircraft, military equipment, ships, space craft, and the like. Aluminum is a good electrical conductor, and it enjoys the advantage over most other metals of being comparatively lightweight. The use of aluminum core wire substantially reduces the weight of a large wiring harness as compared, for example, against copper core wire. Aluminum, however, corrodes easily, and it is much more brittle than some of the other metals such as, for example, copper or silver.

Where they are used, aluminum cores must be protected from corrosion to insure the reliability of the electrical connections that are made with them. Wires composed of other metals may require hermetic sealing of their cores because of exposure to corrosive environments during use. It had been previously proposed to hermetically seal the cores of wires, particularly aluminum wires, to prevent undesired corrosion. An effective hermetic seal must seal both the radial hole in the barrel of the electrical contact, and the insulation around the base of the bare tip of the core. Previously proposed sealing expedients included inserting a soft metal sleeve into the axial cavity of the barrel to cover the small opening that is at approximately the closed end of the barrel, and extending the barrel so that it surrounds the insulation that is adjacent to the bare tip of the core. The barrel is crimped at the regions of the core and the insulation for purposes of both electrical continuity and hermetic sealing, respectively. Considerable care and skill are required because there is no opportunity to directly inspect the bare tip of the core to determine whether it has been fully inserted into the axial cavity in the tubular barrel.

Electrical contact assemblies are often installed at the location where the wiring harness is or is to be mounted in some structure or vehicle. Such off-bench installations generally require the use of hand held tools, rather than bench mounted equipment. Such manually manipulated tools are used to accomplish the required electrical continuity crimping and hermetic sealing (crimp-sealed). The designs of prior electrical contacts that provided for hermetic sealing were such that the operation of manually powered crimp-seal tools required considerable skill and close attention to insure that a good crimp-seal was achieved. The inability to inspect the assembly to determine whether the tip of the core was fully inserted into the axial cavity in the hollow barrel made accurately assembling the contact to the wire a very critical operation. A bench mounted tool designed for performing both electrical continuity and hermetic crimping operations on previous electrical contacts is shown in Schwartzman US Pub. 2007/0039168, Published Feb. 22, 2007.

Typical large installations with aluminum core wire, such as large transport aircraft, use some copper core wire for particularly critical connections. As a result, at the site of the installation, there will be electrical contacts for both aluminum core and copper core wires. These contacts are not the same, and are not interchangeable. Also, the tools used to assemble the contacts to the wires are usually not the same. If a worker is not familiar with both types of contacts, or becomes confused, there is a significant risk that an electrical contact that is designed for one type of core will be assembled to a wire with a different type of core, or that the wrong tool will be used. This presents a serious safety risk. Also, the cost of inventorying and handling different types of contacts and tools for different types of cores is substantial.

Those skilled in the art have long recognized the need for an universal electrical contact or contact assembly for both, copper and aluminum wires that is inexpensive, and capable of being crimped by the identical crimping tool, and, when used with aluminum wire, is easily crimp-sealed by hand in off-bench assembly operations.

Previously proposed expedients for electrical contact systems include, for example, Peterson U.S. Pat. No. 6,814,632. FIG. 19 of this present disclosure is based on this Peterson patent. Peterson proposes providing an adhesive seal between the barrel of an electrical contact and a nonmetallic sleeve. Electrical continuity is said to be established by a crimping process, but it is not clear how Peterson proposes to obtain a seal between the insulation of a wire and the nonmetallic sleeve. As depicted in FIG. 19 to the present disclosure, Peterson proposes a nonmetallic sleeve 60, which has the same internal diameter as the hollow tubular portion 62 of the contact body 64. Sleeve 60 is adhesively joined to and extends from the hollow tubular portion 62 of the contact body. The joining is accomplished by way of an adhesive joint 66 at a joint region 68. The inner diameter of the nonmetallic sleeve 60 is such that it is prevented from sliding over the outside of the hollow tubular portion 62 of the contact body. Instead, the sleeve is proposed as an extension of the hollow tubular portion. Peterson does not suggest any solution to the problem of hermetically sealing a hole in the hollow tubular portion 62. It is not clear how the core 72 of wire 70 is sealed, if it is, unless the insulation on the wire is adhesively bonded to sleeve 60.

Another previously proposed expedient, depicted in FIG. 20 of the present disclosure, purports to be for use with aluminum core wire only. This approach proposes the use of a crimping operation to simultaneously form a continuity crimp between the bare tip of an aluminum core of an electrical wire and the contact body 80, and a hermetic seal between the skirt portion 86 and the coating of insulation on an electrical wire. Skirt portion 86 is a solid part of the contact. A soft metal insert 82 is inserted into the hollow barrel of the contact. Insert 82 hermetically seals hole 84. It also provides a soft metal interface to which the brittle aluminum core may be crimped. Insert 82 prevents direct inspection of the position of the bare tip before and after the crimping process by which electrical continuity is established between the core of the wire and the contact body. The simultaneous crimping process for both electrical continuity and hermetic sealing often requires relatively large, heavy, bench-mounted crimping devices to generate the required degree of force.

These and other difficulties of the prior art have been overcome according to the present invention.

BRIEF SUMMARY OF THE INVENTION

The present invention has been developed in response to the current state of the art, and in particular, in response to these and other problems and needs that have not been fully or completely solved by currently available expedients. Embodiments of the present invention effectively resolve at least the problems and shortcomings identified herein. Certain embodiments of the present invention are particularly suitable for use with aluminum core wire.

An embodiment of electrical contact assembly according to the present invention comprises a contact member that is crimpably deformable into electrical continuity with a bare tip portion of the core of an electrically insulated wire. The electrical continuity crimping operation is generally performed first. The embodiment includes a tubular sleeve member that slips axially over and surrounds the adjacent portions of the contact member and the insulative covering of the wire. In a subsequent operation the tubular sleeve member is deformed into hermetically sealing engagement with both the contact member and the insulative covering. The electrically conductive core of the wire is thus sealed from contact with the environment in which it is used.

Certain embodiments of the present invention comprise a crimpable and sealable contact assembly. The contact assembly includes a contact member and a tubular sleeve member. The contact member has an contactor portion and a barrel portion. These portions are generally aligned along a common axis between a distal end and a proximal end. The barrel portion extends from generally the proximal end toward the contactor portion. The contactor portion extends from the distal end toward the barrel portion. The barrel portion comprises a tubular member that extends generally axially from the proximal end toward the contactor portion. The tubular member has an open end at approximately the proximal end of the contact member and a closed end generally adjacent the contactor portion. The tubular member is adapted to axially receiving a bare tip of a core of a wire. The bare tip of the core is inserted axially therein from the open end of the tubular member. The core is electrically conductive and has a coating of electrical insulation thereon. The tubular member is adapted to being crimpably deformed into electrical continuity with the bare tip.

The tubular sleeve member is generally hollow, open at both ends, and adapted to generally axially and simultaneously receive therein an insulation covered length of the wire adjacent to the bare tip, and at least an axially extending region of the barrel portion. One of the tubular sleeve member or barrel portion includes a detent element, and the other includes a detent engaging element. The detent element is adapted to engage the detent engaging element when the insulation covered length and the axially extending region are both received within the tubular sleeve member. The tubular sleeve member is adapted to being deformable to hermetically seal the core by sealing with both the exterior surface of the barrel and the exterior surface of the insulation on the wire.

The tubular member and the tubular sleeve member are generally comprised of malleable material that does not significantly resiliently resist deformation. That is, the malleable material does not tend to return to its previous form when the deforming agency is removed. In certain embodiments the walls of these members are of such a thickness and material that they are deformable by manually operated hand tools. The electrical continuity function performed by the tubular member is such that it is generally required to be composed of malleable electrically conductive metal, such as, for example, copper, silver, alloys thereof, and the like. Such materials, and their physical and electrically conductive properties are well known to those skilled in the art. The tubular sleeve member need not be electrically conductive, but it must be deformable into hermetically sealing engagement with both the insulative covering on the wire and the tubular member. It may be comprised of the same malleable metals as the tubular member, or it may be comprised of other metals or deformable organic or inorganic polymeric material. Suitable materials are, for example, adapted to being crimped, shrunk, or compressed into hermetically sealing engagement with the external surfaces of the tubular member and the surface of the coating of electrical insulation on the wire. Heat shrinkable organic or inorganic polymeric materials are well known, and such materials are well suited for use according to the present invention.

Embodiments generally avoid the use of any sealing or adhesive material other than the material of the tubular sleeve member and tubular members. Such additional sealing or adhesive materials require controlled application procedures, the inventorying, providing and application of an additional material, all of which increases the complexity of the operations by which the contact assembly is assembled. Also, the characteristics of the components should be such that no surface treatment steps are required to accomplish the desired sealing. Such surface preparation steps include, for example, physically or chemically roughening, smoothing or otherwise modifying the mutually engaging surfaces. The capacity to seal without the use of such extra treatment steps, sealants or adhesives is generally a factor in selecting the materials from which the tubular sleeve member, tubular member, and insulative covering are selected for a particular assembly. Further, in certain embodiments specific materials are selected from amongst the available alternatives specifically for their compatibility with one another.

The tubular sleeve member and mating surfaces of the insulation and tubular member in some embodiments are generally cylindrical. Other configurations are possible, but optimal sealing and ease of operation are often best achieved with generally cylindrical mating surfaces on mating components.

Certain embodiments, particularly those involving a some what brittle core, such as aluminum, include a crimp cushioning region that is adapted to being crimpably deformed into electrical continuity with the bare tip of a brittle core. The crimp cushioning region may take the form of, for example, a soft metal insert inside of the tubular member in the region where the crimping deformation occurs. When crimped, the inside surface of the soft metal insert directly engages and conforms to the brittle core without cracking it. The outside surface of the insert directly engages the inside surface of the tubular member. Electrical continuity is thus established from the core to the insert, to the tubular member of the barrel portion, to the tubular sleeve member (in embodiments where the tubular sleeve member is electrically conductive) and to a contactor portion of the contact member. Such soft metal inserts include, for example, a fully annealed generally cylindrical hollow copper or silver insert, or the like. The insert is fixed in a desired location within the tubular member, for example, by friction. For example, inserting a relatively cold insert into a relatively hot tubular member allows the insert to slide into the relatively enlarged tubular member. When the two components reach approximately the same temperature the tubular member shrinks into a tight fit around the insert, which holds the insert in the desired location relative to the tubular member. Such a shrink fit is accomplished, for example, by an operation that is sometimes described as "sweating" the parts together. Also, the parts may be press fit together in a pressing operation. Embodiments with such a soft metal insert employ an insert that does not reach the full length of the axial cavity in the barrel. Thus, the generally radial hole through the barrel portion near the closed end of the tubular member is not blocked by the insert.

The generally radial hole through the tubular member serves as an inspection hole that is adapted to being inspectingly associated with the bare tip of the core when that bare tip is substantially fully inserted to approximately the closed end of the tubular member. When the core is inserted for substantially the full length of the axial cavity, a spot on the bare tip of the core is visible through the inspection hole. It is thus possible to quickly and accurately visually check whether the bare tip of the core has been fully inserted into the barrel both before and after the continuity crimping step has been accomplished. If the bare tip is visible it indicates that the core is in the correct location in the barrel portion. Generally, the correct position is when the bare tip is fully inserted to the full depth of the tubular member, although other configurations may be desired for the purposes of a particular installation. In such other configurations an inspection hole may be positioned along the axially length of the tubular member at a desired location.

In certain embodiments the sleeve member comprises substantially transparent organic or inorganic polymeric material. In some such embodiments the substantially transparent polymeric material is adapted to being deformed by heat-shrinking into hermetically sealed engagement with the tubular member and the insulation on the wire. This hermetically seals the core. When the contact assembly is fully assembled to the wire, the substantially transparent polymeric material permits the bare tip of the core to be visually inspected through the inspection hole in the tubular member.

A detent engaging element and a detent element are provided in certain embodiments as a positioning aid during the assembly of the contact assembly. According to certain embodiments, these elements are engaged after continuity crimping has occurred. The engagement of these elements holds the tubular sleeve member at a desired location relative to the tubular member as the sleeve deformation step is initiated. A worker can feel and/or hear when these two elements engage with one another. By pulling on the contact member and the tubular sleeve member in a direction to disengage them a worker can determine whether the detent and detent engaging elements are still engaged. This quick and easy check, after the wire is manipulated to a new position for some purpose, allows a worker to determine that the components are properly positioned prior to initiating a sealing crimp. This tactile or audible clue permits a worker to proceed quickly to the tubular sleeve member deformation step with confidence that the tubular sleeve member is properly positioned, and will remain properly positioned during the tubular sleeve member deforming step. According to some embodiments, for example, the detent engaging element comprises a generally circumferential groove in the tubular member or the tubular sleeve member, and the detent element comprises one or more protrusions on the other member. Such protrusions are adapted to engage the generally circumferential groove.

The contact assembly is assembled to a wire by selecting a contact member that has a contactor portion and a barrel portion. The barrel portion generally extends from a proximal end of the contact member towards the contactor portion. The contactor portion generally extends from the distal end of the contact member towards the barrel portion. The barrel portion comprising a tubular member that extends generally axially from the proximal end toward the contactor portion. The tubular member has an open end at approximately the proximal end. A bare tip of a core of the wire is inserted axially into the tubular member from its open end. The core is electrically conductive and has a coating or covering of electrical insulation thereon. The tubular member is crimpably deformed into electrical continuity with the bare tip. In embodiments, the continuity crimped assembly is checked to determine that a spot on the tip of the core is visible through the inspection hole. A generally tubular sleeve member is provided generally around an insulation covered length of the wire adjacent to the bare tip of the core, and at least an axially extending region of the barrel portion. According to certain embodiments, one of the tubular sleeve member and barrel portion includes a detent element and the other includes a detent engaging element. The generally tubular sleeve member is slipped axially over the barrel portion of the continuity crimped assembly to a location where the detent element and detent engaging element are engaged with one another. The tubular sleeve member is then deformed to hermetically seal the core.

According to certain embodiments, the physical characteristics of the deformable materials are such that the deforming steps are performed manually. That is, the tools that are used are powered only by the worker's hands rather than by some external power source.

In those embodiments wherein the hollow tube member includes an inspection hole therethrough and the sleeve member comprising substantially transparent polymeric material, it is possible to perform a quality control operation by checking to see if the bare tip of the core is visible through the deformed sleeve member.

To acquaint persons skilled in the pertinent arts most closely related to the present invention, an embodiment of a contact assembly that illustrates a best mode now contemplated for putting the invention into practice is described herein by, and with reference to, the annexed drawings that form a part of the specification. The exemplary contact assembly is described in detail without attempting to show all of the various forms and modifications in which the invention might be embodied. As such, the embodiments shown and described herein are illustrative, and as will become apparent to those skilled in the arts, can be modified in numerous ways within the scope and spirit of the invention, the invention being measured by the appended claims and not by the details of the specification or drawings.

Other objects, advantages, and novel features of the present invention will become more fully apparent from the following detailed description of the invention when considered in conjunction with the accompanying drawings, or may be learned by the practice of the invention as set forth herein.

BRIEF DESCRIPTION OF THE DRAWINGS

The present invention provides its benefits across a broad spectrum. While the description which follows hereinafter is meant to be representative of a number of such applications, it is not exhaustive. As those skilled in the art will recognize, the basic apparatus taught herein can be readily adapted to many uses. This specification and the claims appended hereto should be accorded a breadth in keeping with the scope and spirit of the invention being disclosed despite what might appear to be limiting language imposed by the requirements of referring to the specific examples disclosed.

Referring particularly to the drawings for the purposes of illustrating the invention and its presently understood best mode only and not limitation.

DETAILED DESCRIPTION OF THE PREFERRED EMBODIMENTS

Figure 1:
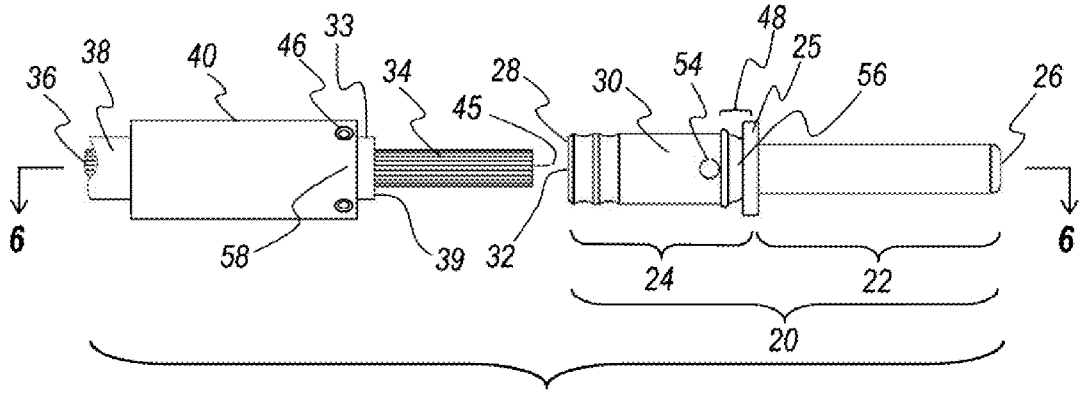
FIG. 1 is a top view of an unassembled crimpable and sealable contact assembly, in assemblable relationship with an electrically insulated wire, wherein a section of insulation has been stripped from an electrically conductive core of the wire to form a bare tip, and a sleeve member of the contact assembly has been inserted over the insulation of the wire adjacent to the bare tip.
Figure 2:
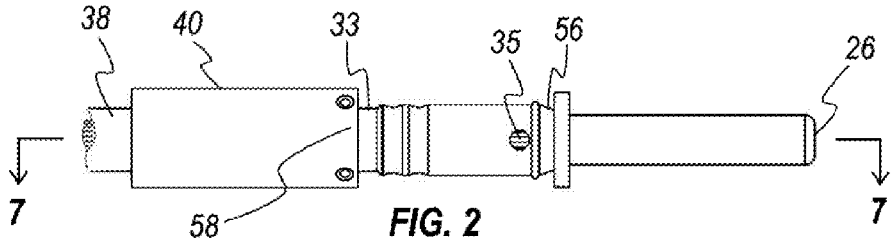
FIG. 2 is a top view of the embodiment of FIG. 1 illustrating a partially assembled configuration in which the bare tip of the core has been fully inserted into a hollow tube member in the barrel portion of the contact member.
Figure 3:
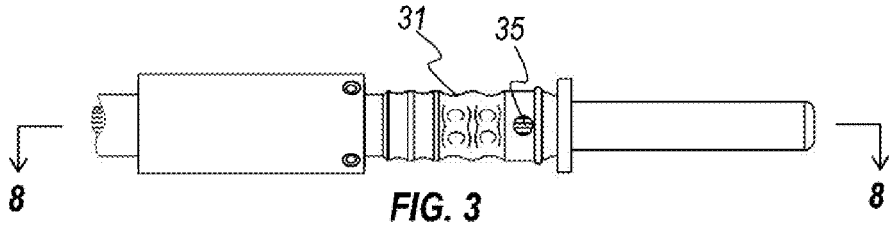
FIG. 3 is a top view of the embodiment of FIGS. 1-2 illustrating a partially assembled configuration in which the hollow tube member has been crimpably deformed into electrical continuity with the bare tip of the core, and a spot on the core near its end is visible through the inspection hole.
Figure 4:
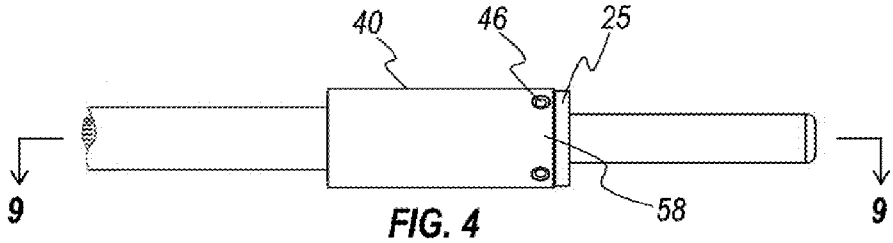
FIG. 4 is a top view of the embodiment of FIGS. 1-3 illustrating a partially assembled configuration in which the sleeve member has been slipped axially over the exterior of the crimpably deformed hollow tube member, and a detent member has been engaged by a detent engaging member between the barrel portion and the sleeve member to hold the sleeve member in position relative to the barrel portion for final assembly.

Referring now to the drawings wherein like reference numerals designate identical or corresponding parts throughout the several views. It is to be understood that the drawings are diagrammatic and schematic representations of various embodiments of the invention, and are not to be construed as limiting the invention in any way. The use of words and phrases herein with reference to specific embodiments is not intended to limit the meanings of such words and phrases to those specific embodiments. Words and phrases herein are intended to have their ordinary meanings, unless a specific definition is set forth at length herein.

Figure 6:
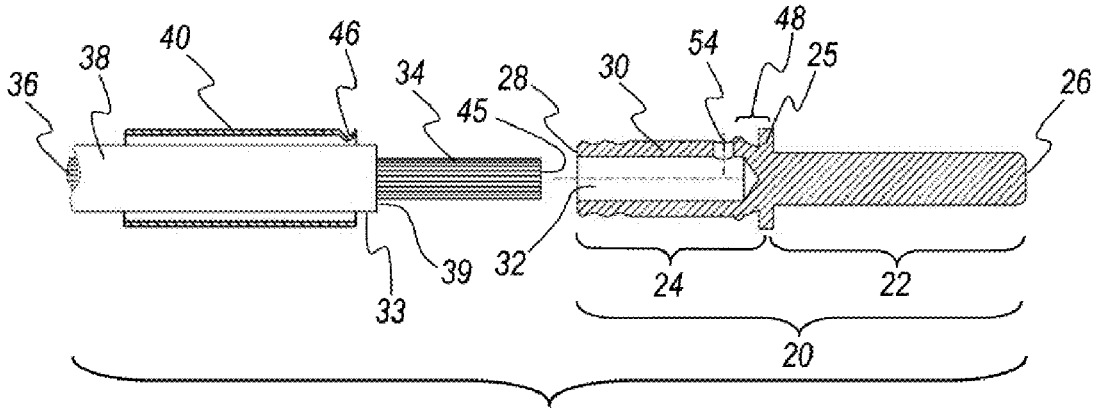
FIG. 6 is a view of the embodiment of FIG. 1 partially in elevation and partially in section taken along line 6-6 in FIG. 1 with the components of the contact assembly shown in cross-section.
Figure 21:
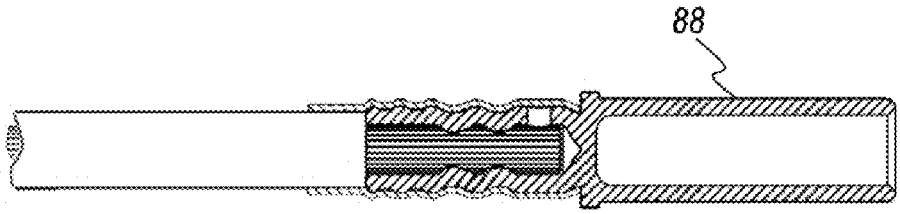
FIG. 21 is a side view of an assembled configuration partially in elevation and partially in section with the components of the contact assembly shown in cross-section wherein the contactor portion is a female socket.

Referring particularly to the drawings, there is illustrated generally at 20 in FIG. 1 an exploded view including a crimpable and sealable contact assembly generally in alignment with an electrically insulated wire 38. The contact assembly includes an electrical contact member 20 and a barrel portion 24 that are generally aligned along a common axis between a distal end 26 and a proximal end 28. A tubular sleeve member 40 is illustrated in an unassembled configuration generally axially aligned with but separated from barrel portion 24. Tubular sleeve member 40 as shown, for example, FIGS. 1 and 6 is slidably and axially received over the insulation adjacent to a bare tip 34 of a core 36. The barrel portion 24 extends from the proximal end 28 toward a contactor portion 22. The contactor portion 22 extends from the distal end 26 toward the barrel portion 24. In the embodiment chosen for illustration in, for example, FIGS. 1, 6, and 18, a shoulder member 25 is located generally at the junction between the barrel and electrical contact portions. The barrel portion 24 comprises a tubular member 30, which extends generally axially from the proximal end 28 toward the contactor portion 22. The contactor portion may be either a male pin or a female socket such as that illustrated at 88 in FIG. 21.

Turning now to FIG. 6, which depicts a partial cross-section of the exploded assembly depicted in FIG. 1, the tubular member 30 has an open end 32 at approximately the proximal end 28, and is adapted to axially receive a bare tip 34 of a core of a wire 36 inserted axially therein from the open end 32. In the embodiment chosen for purposes of illustration, the barrel portion is hollow from the proximal end to approximately the electrical contact portion, and the core 36 is a solid core. The core 36 of wire 38 is electrically conductive and has a covering of electrical insulation thereon. The covering of electrical insulation is generally cut so that cut surface 39 will mate with proximal end 28 when the bare tip 34 is fully inserted into tubular member 30. The cut surface 39 is typically perpendicular to the longitudinal axis of the wire and forms the end of a right cylindrical covering of insulation on the core 36. The tubular member 30 is adapted to being crimpably deformed into electrical continuity with the bare tip 34. In certain embodiments the characteristics of the barrel and the core allow for the use of a lightweight, manually held crimping tool for forming the electrical continuity crimp between the barrel and the core.

Figure 7:
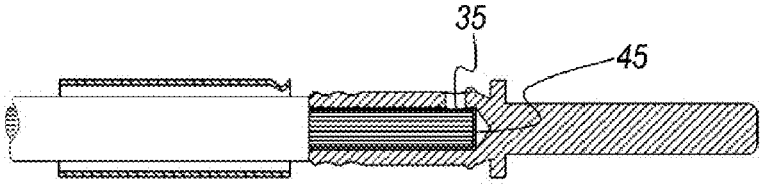
FIG. 7 is a side view of the partially assembled configuration of FIG. 2 partially in elevation and partially in section taken along line 7-7 in FIG. 2 with the components of the contact assembly shown in cross-section.
Figure 8:
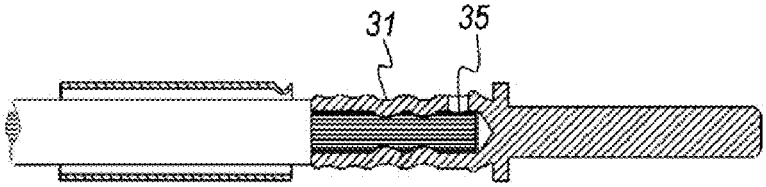
FIG. 8 is a side view of the partially assembled configuration of FIG. 3 partially in elevation and partially in section taken along line 8-8 in FIG. 3 with the components of the contact assembly shown in cross-section.
Figure 9:
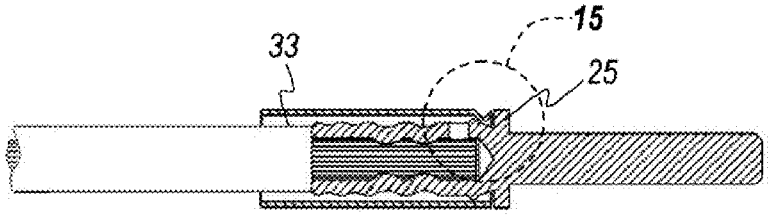
FIG. 9 is a side view of the partially assembled configuration of FIG. 4 partially in elevation and partially in section taken along line 9-9 in FIG. 4 with the components of the contact assembly shown in cross-section with a detent element and a detent engaging element interengaged to secure the sleeve member in position relative to the barrel portion for the final assembly step.
Figure 10:
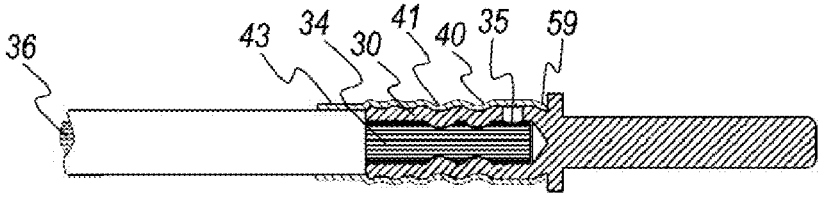
FIG. 10 is a side view of the partially assembled configuration of FIG. 5 partially in elevation and partially in section taken along line 10-10 in FIG. 5 with the components of the contact assembly shown in cross-section.

As illustrated, for example, in FIGS. 7 through 10, the crimp seal assembly process includes the steps of inserting the end 45 of bare tip 34 fully into tubular member 30 (FIG. 7). Next, tubular member 30 is crimped as indicated at 31, for example, by the application of mechanical or electromagnetic force, into electrical continuity with bare tip 34 (FIG. 8). Tubular sleeve member 40 is then slipped axially into a configuration where it surrounds both insulation covered length 33 of the wire and the barrel portion 24 including the region where hole 54 is located. In this configuration the detent and detent engaging elements are interengaged to hold tubular sleeve member 40 in position for the sealing operation to be performed (FIG. 9). Tubular sleeve member 40 is then sealingly deformed into hermetic sealing engagement with the adjacent exterior surfaces of contact member 20 and the insulated wire. The core 36 is thus hermetically sealed (FIG. 10).

Tubular sleeve member 40, which is generally hollow and open at both ends, is adapted to generally axially and simultaneously receive therein an insulation covered length of wire 33 adjacent bare tip 34, and at least an axially extending region of the barrel portion 24. The cross-section of the sleeve member can take on numerous shapes as may be required to accommodate the barrel portion and the insulation covering on the wire, including a circular cross-section resulting in a cylindrical sleeve member. When tubular sleeve member 40 has been deformed into sealing engagement with insulation covered length 33, a section 43 (FIG. 10) of tubular sleeve member 40 is drawn down into hermetically sealing engagement with the exterior surface of the electrical insulation. A barrel sealing portion 41 of tubular sleeve member 40 is drawn down into a hermetic seal with an exterior surface of barrel portion 24. The axially inner end portion 58 of tubular sleeve member 40 is deformed down into groove 56 as illustrated at 59 in FIG. 10.

Figure 12:
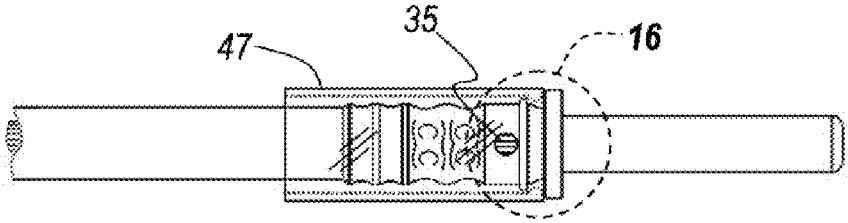
FIG. 12 is a top view of an embodiment in a partially assembled configuration similar to that illustrated in FIG. 4 wherein the bare tip is visible through the substantially transparent sleeve member of FIG. 11.
Figure 14:
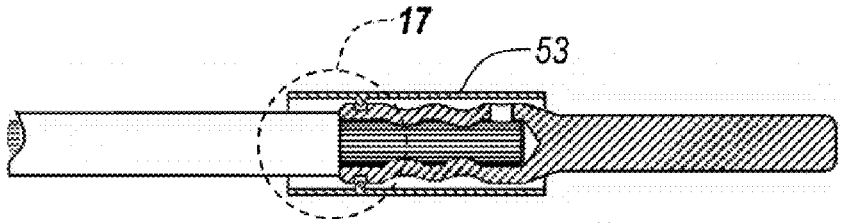
FIG. 14 is a side view partially in elevation and partially in section of a further embodiment with the components of the contact assembly in cross-section wherein the detent element and detent engaging element are located substantially adjacent the proximal end of a shoulderless contact member, and an electrical continuity crimp operation has been performed, but a sealing operation has not.
Figure 15:
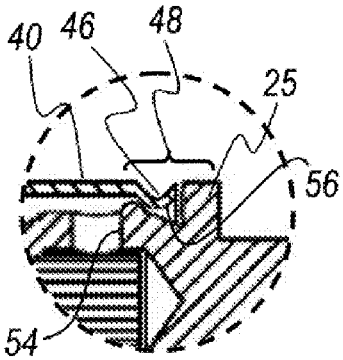
FIG. 15 is an enlarged partial cross-sectional view taken along line 15 in FIG. 9 illustrating the engagement of the detent element and detent engaging element of the embodiment of FIG. 9.
Figure 16:
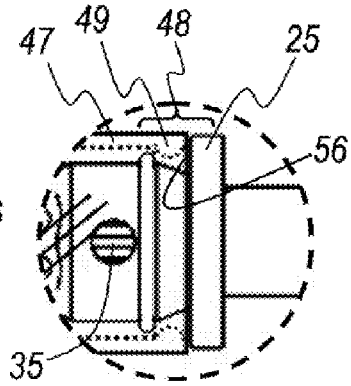
FIG. 16 is an enlarged partial cross-sectional view taken along line 16 in FIG. 12 illustrating the engagement of the detent element and detent engaging element of the embodiment of FIG. 12.
Figure 17:
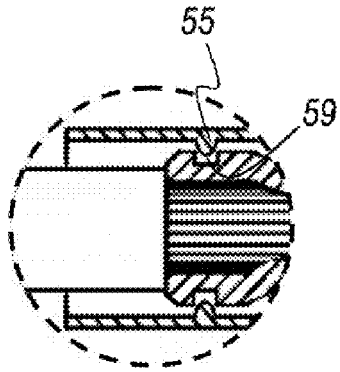
FIG. 17 is an enlarged partial cross-sectional view taken along line 17 in FIG. 14 illustrating the engagement of the detent element and detent engaging element of the embodiment of FIG. 9.

One of tubular sleeve member 40 and barrel portion 24 includes a detent element, for example, 46, and the other of the sleeve member 40 and barrel portion 24 includes a detent engaging element, for example, 48. For example, referring to FIG. 1, the detent element 46 may comprise one or more dimples formed in the sleeve prior to commencement of the assembly process, and the detent engagement element 48 may comprise a generally circumferential groove 56 formed in the barrel portion prior to commencement of the assembly process. The detent element 46 is adapted to engage the generally circumferential groove 56 portion of detent engaging element 48 when the insulation covered length 33 and the axially extending section of the barrel portion 24 are received in the tubular sleeve member 40. Further, the detent element and detent engaging element may be positioned at one or more of various locations along the barrel portion 24. For example, FIG. 15 and FIG. 16 are close-up views of the detent element and detent engaging element for the embodiments of FIG. 9 and FIG. 12, respectively, wherein the detent element and detent engagement element are located along the barrel portion and approximately adjacent to the contactor portion. FIG. 14 and FIG. 17, for example, depict an alternate location for the detent element and detent engagement element, wherein these elements are located along the barrel portion approximately adjacent proximal end 28.

Figure 5:
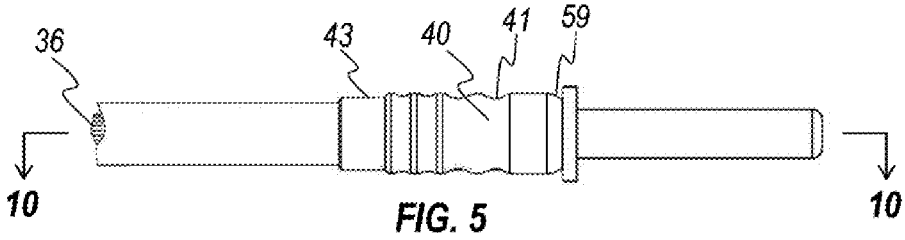
FIG. 5 is a top view of the embodiment of FIGS. 1-4 illustrating a fully assembled configuration in which the sleeve member has been deformed to fully encapsulate and hermetically seal the crimped barrel and the end of the insulation so that the core is hermetically sealed from the environment.
Figure 11:
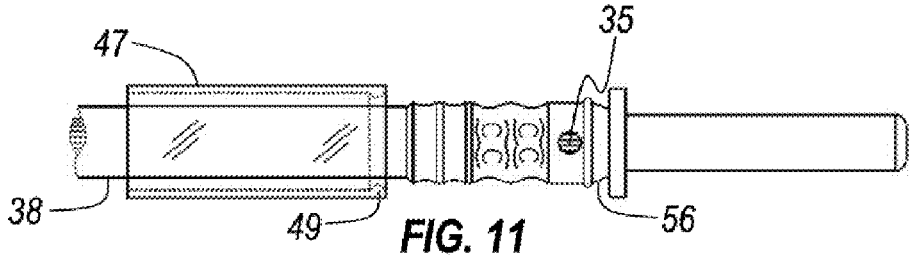
FIG. 11 is a top view of an embodiment in a partially assembled configuration similar to that illustrated in FIG. 3 wherein the sleeve member is comprised of a substantially transparent heat shrinkable polymeric material, and the axially outer end of the bare tip of the core is visible through an inspection hole.
Figure 13:
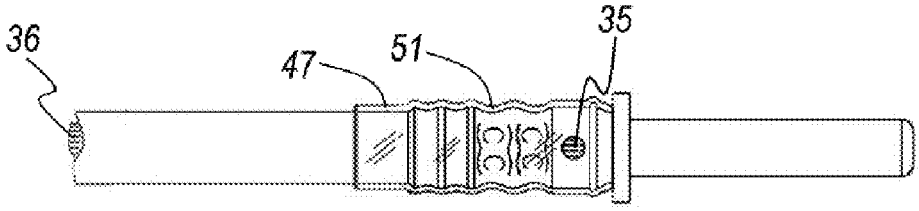
FIG. 13 is a top view of an embodiment in a fully assembled configuration similar to that illustrated in FIG. 5 wherein the bare tip is visible through the substantially transparent sleeve member of FIG. 11.

The tubular sleeve member 40 is further adapted to being deformable to hermetically seal the core 36 as depicted, for example, in FIG. 5, FIG. 10 and FIG. 13. To facilitate such deformation, the sleeve member can be made of one of several materials which may be crimpable or heat-shrinkable. Moreover, the sleeve may be comprised of an electrically conductive metallic material. Tubular sleeve member materials comprise, for example, copper or a heat-shrinkable organic or inorganic polymer, because they can generally be crimped or shrunk, respectively, using lightweight, portable tools. Additionally, as illustrated, for example, in FIG. 11 through FIG. 13, the tubular member 30 may have a hole 54 generally radially thererthrough adjacent the closed end of tubular member 30. The sleeve member may be made of a substantially transparent heat-shrinkable polymer, allowing for viewing through hole 54 even after the sleeve has been deformed to form the hermetic seal. As illustrated, for example, in FIG. 10, hole 54 is adapted to being inspectingly associated with a spot 35 on bare tip 34 when bare tip 34 is substantially fully inserted into the tubular member 30. End 45 of bare tip 34 is at about the closed end of tubular member 30 when spot 35 becomes visible through hole 54.

Some embodiments of the present invention may also include a shoulder member 25 which is located axially along contact member 20 medial of the proximal and distal ends. As shown, for example, in FIG. 6, the shoulder member 25 may be positioned at the junction of the electrical contactor portion 22 and barrel portion 24. Further, as depicted, for example, in FIG. 15 and FIG. 16, the shoulder member 25 may form part of the detent engaging element 48, where the shoulder member prevents or helps prevent the sleeve member 40 from sliding toward the distal end 26 beyond the shoulder member's location prior to deformation of the sleeve member to form the hermetic seal. Certain embodiments do not include a shoulder. See, for example, FIG. 14.

Figure 18:
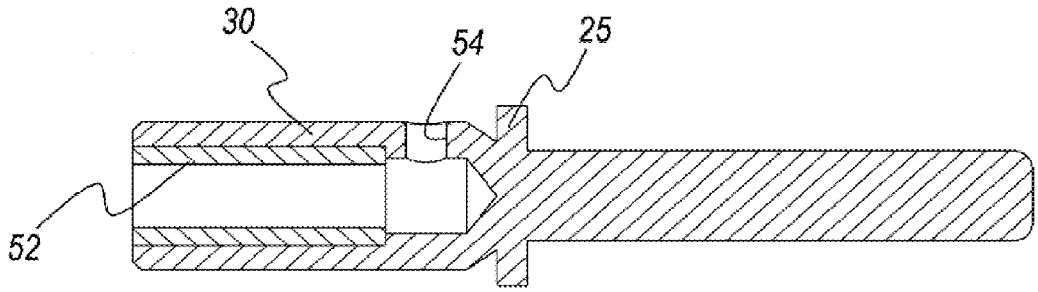
FIG. 18 is a cross-sectional view of an embodiment with a crimp cushioning region positioned within the hollow tube member of the barrel portion.
Figure 19:
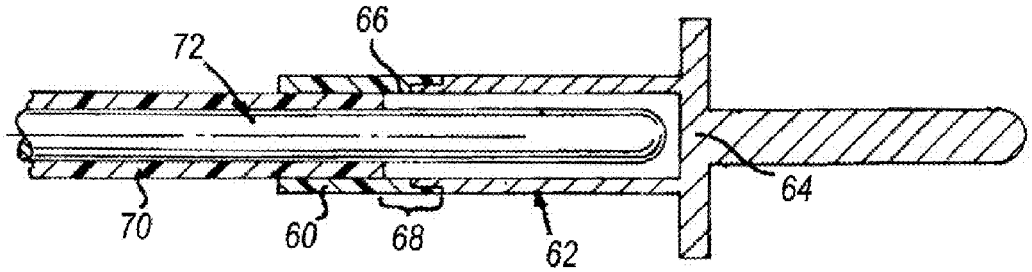
FIG. 19 PRIOR ART
FIG. 19 is a cross-sectional view of a prior art electrical contact embodiment.
Figure 20:
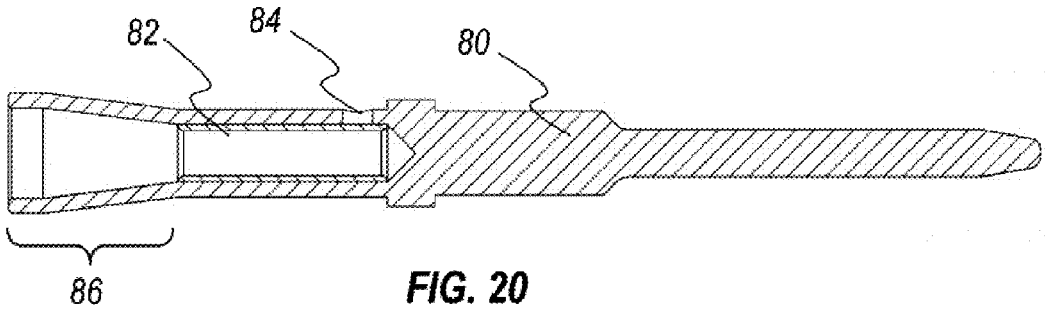
FIG. 20 PRIOR ART
FIG. 20 is a cross-sectional view of a second prior art electrical contact embodiment.

As depicted, for example, in FIG. 18, in some embodiments of the present invention the tubular member 30 may include a crimp cushioning region 52, which is adapted to being crimpably deformed into electrical continuity with the bare tip 34 of the core of a wire. This crimp cushioning region provides cushioning for more brittle wire material such as aluminum during the crimping of the tubular member 30 into electrical continuity with a brittle core. The crimp cushioning region 52 may comprise a soft metal liner in tubular member 30. The liner does not obscure the hole 54.

With particular reference to FIGS. 11 through 13, and 16, an embodiment is illustrated in which tubular sleeve member 47 is substantially transparent. This transparent member includes a detent element 49 in the form of a ridge element molded into the inner generally cylindrical surface of member 47. This ridge element engages the detent engaging element on the contact member to hold the assembly in the proper configuration while the crimp sealing operation is being performed. The spot 35 on bare tip 34 is visible through hole 54 even after the assembly operation has been completed as indicated at 51. This permits quick and reliable inspection of the completed assembly.

IN the embodiment of FIGS. 14 and 17, the detent elements are adjacent the proximal end of the contact member. Tubular sleeve member 53 includes nipple elements, of which 55 is typical, projecting radially inwardly from the inner circumference of tubular sleeve member 53. Adjacent the proximal end of the contact member is a circumferential groove element 59. Elements 55 and 59 together provide the detent and detent engaging elements to hold tubular sleeve member 53 in the proper configuration for crimp sealing.

Embodiments of contact assemblies according to the present invention are well suited for use with both aluminum and copper cored wire. This dual capability greatly simplifies inventory control and reduces the risk of errors on large installations, such as transport aircraft, where both copper and aluminum core wire are being installed. These contact assemblies are also useful in installations where other types of stranded or solid core wire are being installed. Accordingly, the present invention should not be construed as limited solely to any particular core composition or configuration.

It will be appreciated that embodiments of the present invention may be profitably employed in the context of a wide variety of insulated stranded and solid core wires, and in original, retrofit and maintenance operations. Aluminum cores typically require hermetic sealing. Copper and other metal cores need to be protected from corrosion in some marine and other corrosive environments such as on ships, aircraft, and shore installations. Any material or combination of materials, compatible with the functions and operation of the present invention is contemplated as being within the scope of the present invention. Some manufacturing operations involve operations that are performed in corrosive environments. For maintenance and retrofit operations it is often impossible or impractical to remove the wiring harness and take it to a bench to work on. Original installations must sometimes be completed at the site of use where a bench is not available.

It will be appreciated that the required deforming operations may be accomplished by a variety of devices and structures other than manually operated deforming tools. Powered hand crimping tools, and powered bench mounted tools can be employed, if desired.

What have been described are embodiments in which modifications and changes may be made without departing from the spirit and scope of the accompanying claims. Many modifications and variations of the present invention are possible in light of the above teachings. It is therefore to be understood that, within the scope of the appended claims, the invention may be practiced otherwise than as specifically described and shown.

What is claimed is:

1. A crimpable and sealable contact assembly comprising:

a contact member having a contactor portion extending from a distal end toward a barrel portion, said barrel portion extending from a proximal end toward said contactor portion, said barrel portion comprising a tubular member, said tubular member having an open end and a closed end, said open end being at approximately said proximal end, and said closed end being spaced from said open end toward said contactor portion, a hole extending through said tubular member approximately adjacent said closed end, said tubular member being adapted to receive a bare tip of a core of a wire inserted therein from said open end and extending to approximately said closed end, said core being electrically conductive and having a covering of electrical insulation thereon, said tubular member adapted to being crimpably deformed into electrical continuity with a spot on said bare tip that is adapted to being visible through said hole after said tubular member is crimpably deformed; and a tubular sleeve member, said tubular sleeve member being initially separate from said contact member, said tubular sleeve member adapted to slidably receiving therein both an insulation covered length of said wire adjacent said bare tip and a region of said barrel portion, said hole being in said region, said tubular sleeve member adapted to being deformable into direct sealing engagement with said insulation covered length and said region to hermetically seal said core.

2. A crimpable and sealable contact assembly of claim 1 wherein said contactor portion is a male pin.

3. A crimpable and sealable contact assembly of claim 1 wherein said tubular member includes a crimp cushioning region adapted to being crimpably deformed into electrical continuity with said bare tip.

4. A crimpable and sealable contact assembly of claim 1 wherein said tubular sleeve member is substantially comprised of electrically conductive metallic material, and said tubular sleeve member is adapted to being crimpably deformable to hermetically seal said core.

5. A crimpable and sealable contact assembly of claim 1 wherein said tubular sleeve member is comprised of a heat shrinkable polymeric material, and said tubular sleeve member is adapted to being heat-shrinkably deformable to hermetically seal said core.

6. A crimpable and sealable contact assembly of claim 1 wherein said tubular sleeve member comprises substantially transparent heat shrinkable polymeric material.

7. A crimpable and sealable contact assembly comprising:

a contact member having a contactor portion extending from a distal end toward a barrel portion, said barrel portion extending from a proximal end toward said contactor portion, said barrel portion comprising a tubular member, said tubular member having an open end and a closed end, said open end being at approximately said proximal end, and said closed end being spaced from said open end toward said contactor portion, a hole extending through said tubular member approximately adjacent said closed end, said tubular member being adapted to receive a bare tip of a core of a wire inserted therein from said open end and extending to approximately said closed end, said core being electrically conductive and having a covering of electrical insulation thereon, said tubular member adapted to being crimpably deformed into electrical continuity with a spot on said bare tip being visible through said hole after said tubular member is crimpably deformed; and a tubular sleeve member, said tubular sleeve member being initially separate from said contact member, said tubular sleeve member adapted to slidably receiving therein both an insulation covered length of said wire adjacent said bare tip and a region of said barrel portion, said hole being in said region, one of said tubular sleeve member and barrel portion includes a detent element and the other includes a detent engaging element, said detent element being adapted to engage said detent engaging element when said insulation covered length and said region are received in said tubular sleeve member, said tubular sleeve member adapted to being deformable into sealing engagement with said insulation covered length and said region to hermetically seal said core.

8. A method of installing a crimped and sealed contact assembly comprising the steps of:

selecting a contact member having a contactor portion and a barrel portion, said barrel portion extending from a proximal end of said contact member toward said contactor portion, and said contactor portion extending from a distal end of said contact member toward said barrel portion, said barrel portion comprising a tubular member extending generally axially from said proximal end toward said contactor portion, said tubular member having an open end at approximately said proximal end and a closed end axially spaced from said open end toward said contactor portion;

inserting a bare tip of a core of a wire axially into said tubular member from said open end, said core being electrically conductive and having a covering of electrical insulation thereon;

crimpably deforming said tubular member into electrical continuity with said bare tip;

providing a generally tubular sleeve member generally around an insulation covered length of said wire adjacent said bare tip and at least an axially extending external region of said barrel portion, one of said tubular sleeve member and barrel portion including a detent element and the other of said tubular sleeve member and barrel portion including a detent engaging element;

engaging said detent element with said detent engaging element; and deforming said tubular sleeve member to hermetically seal said core.

9. A method of installing a crimped and sealed contact assembly of claim 8 including manually performing said crimpably deforming and said deforming.

10. A method of installing a crimped and sealed contact assembly of claim 8 wherein said tubular member includes an inspection hole therethrough and said sleeve member comprising substantially transparent polymeric material, including checking after said deforming to determine whether said bare tip is visible through said inspection hole.

11. A crimpable and sealable contact assembly of claim 1 wherein said core is comprised of aluminum, said tubular member is adapted to being manually crimpably deformable, said tubular sleeve member is substantially comprised of copper and is adapted to being manually crimpably deformable to hermetically seal said core.

12. A method of installing a crimped and sealed contact assembly of claim 8 wherein said core is comprised of aluminum, said tubular sleeve member is comprised substantially of copper, and including manually performing said crimpably deforming and said deforming.

13. A crimpable and sealable contact assembly comprising:

a contact member having a contactor portion extending from a distal end toward a barrel portion, said barrel portion extending from a proximal end toward said contactor portion, said barrel portion comprising a tubular member, said tubular member having an open end and a closed end, said open end being at approximately said proximal end, and said closed end being spaced from said open end toward said contactor portion, a hole extending through said tubular member approximately adjacent said closed end, said tubular member being adapted to receive a bare tip of a core of a wire inserted therein from said open end and extending to approximately said closed end, said core being electrically conductive and having a covering of electrical insulation thereon, said tubular member adapted to being crimpably deformed into electrical continuity with a spot on said bare tip that is adapted to being visible through said hole after said tubular member is crimpably deformed; and a tubular sleeve member, said tubular sleeve member being initially separate from said contact member, said tubular sleeve member adapted to slidably receiving therein both an insulation covered length of said wire adjacent said bare tip and an axially extending region of said barrel portion, said hole being in said region, said tubular sleeve member adapted to being deformable into sealing engagement with said insulation covered length and said region to hermetically seal said core, and one of said tubular sleeve member and said barrel portion includes a detent element and the other includes a detent engaging element, said detent element being adapted to engage said detent engaging element when said insulation covered length and said axially extending region are received in said tubular sleeve member.

14. A crimpable and sealable contact assembly of claim 13 wherein said detent engaging element comprises a generally circumferential groove, and said detent element comprises one or more protrusions adapted to engage said generally circumferential groove.

* * * * *